US005892194A

United States Patent [19]

Uotome et al.

[11] Patent Number: 5,892,194

[45] Date of Patent: Apr. 6, 1999

[54] SEALED CONTACT DEVICE WITH CONTACT GAP ADJUSTMENT CAPABILITY

[75] Inventors: Riichi Uotome, Katano; Takaaki Chuzawa, Hirakata; Takehiko Toguchi, Kadoma; Toshiyuki Suzuki, Tsu; Kiyoshi Goto, Itami; Ritsu Yamamoto, Hirakata; Masahiro Ito, Amagasaki, all of Japan

[73] Assignee: Matsushita Electric Works, Ltd., Osaka, Japan

[21] Appl. No.: 827,006

[22] Filed: Mar. 25, 1997

[30] Foreign Application Priority Data

| | | | |
|---|---|---|---|
| Mar. 26, 1996 | [JP] | Japan | 8-070735 |
| May 31, 1996 | [JP] | Japan | 8-139112 |
| Nov. 27, 1996 | [JP] | Japan | 8-316345 |

[51] Int. Cl.[6] ..... H01H 33/70; H01H 67/02

[52] U.S. Cl. ..... 218/68; 335/131; 335/151; 335/154

[58] Field of Search ..... 218/13, 68–78, 218/118–126, 155–157; 335/131, 151–154, 185, 194, 195–201, 248, 252; 200/243, 16 A

[56] References Cited

U.S. PATENT DOCUMENTS

| | | | |
|---|---|---|---|
| 2,433,703 | 12/1947 | Meckelburg | 335/261 |
| 3,189,705 | 6/1965 | Geusendam | 200/243 X |
| 3,571,770 | 3/1971 | Dew | 335/256 |
| 4,450,423 | 5/1984 | Morishita | 335/151 |
| 4,638,275 | 1/1987 | Belbel et al. | 335/131 X |
| 4,706,037 | 11/1987 | Prouty et al. | 335/248 |
| 4,755,781 | 7/1988 | Bogner | 335/131 |
| 5,394,128 | 2/1995 | Perreira et al. | 335/126 |
| 5,519,370 | 5/1996 | Perreira et al. | 335/154 |

FOREIGN PATENT DOCUMENTS

| | | |
|---|---|---|
| 0 577 185 | 1/1994 | European Pat. Off. . |
| 7-122149 | 9/1995 | Japan . |
| WO 92/17897 | 10/1992 | WIPO . |

*Primary Examiner*—J. R. Scott

*Attorney, Agent, or Firm*—Armstrong, Westerman, Hattori, McLeland & Naughton

[57] ABSTRACT

A sealed switch has a vessel defining therein a hermetically sealed space which receives a pair of fixed contacts and a movable contact bridging the fixed contact. The movable contact is movable between an ON-position of closing with the fixed contact and an OFF-position of separating from the fixed contacts. Hydrogen gas or hydrogen rich gas is filled in the sealed space in order to suppress arc development between the movable and fixed contacts. The plunger carries at its axial one end the movable contact and carrying at the other axial end an actuator which moves the plunger axially for movement of the movable contact from the OFF-position to the ON-position. An over-travel spring is provided to give a bias for moving the movable contact relative to the plunger in order to develop a contacting pressure between the movable and fixed contacts. The over-travel spring is supported to a spring holder secured to the plunger. The plunger is formed with a threaded portion which extends through the actuator to allow the plunger to move axially relative to the actuator for adjustment of a contact gap between the movable and fixed contact, and the spring holder is formed with stopper protrusions which project in abuttable and slidable relation to the interior surface of the vessel such that the movable contact is prevented from rotating together with the plunger. Accordingly, the spring holder is best utilized to restrict the movable contact from rotating together with the actuator to enable an easy adjustment of the contact gap simply by rotating the actuator.

12 Claims, 9 Drawing Sheets

42
43
14
40
41
49
46
45
48
50
61
65
62
63
64

30
32
33
70
71
72
73
73
74
74
34
40

SEALED CONTACT DEVICE WITH CONTACT GAP ADJUSTMENT CAPABILITY

BACKGROUND OF THE INVENTION

1. Field of the Invention

The present invention is directed to a sealed contact device with contact gap adjustment capability, and more particularly to a sealed contact device filled with an arc diminishing gas and having a small adjustable contact gap.

2. Description of the Prior Art

WO 92/17897 discloses a sealed relay or contact device in which a movable contact and associated fixed contacts are disposed within a vacuum chamber. The use of the vacuum chamber enables to reduce a contact gap between the movable contact and the fixed contact in addition to restraining an arc development between the contacts. A demand is frequently seen in the manufacture of the device to adjust the contact gap between the movable and fixed contacts or the amount of an over-travel distance of a plunger carrying the movable contact. For this purpose, a threaded engagement is expected to be used between a plunger carrying the movable contact and an actuator which is driven by an external driving force to move the plunger in the direction of closing the contacts. When modifying the above prior art device with the threaded engagement, it is required to restrict the relative rotation of the plunger and the actuator so that the rotation of the actuator can be translated into a corresponding axial movement of the plunger. Notwithstanding the addition of a structure of restricting the relative rotation of the plunger to the actuator, it is further required that the structure should not interfere with the movement of the movable contact. Therefore, the contact gap adjustment is not easily achieved for the contact device. In addition, a minor rotation of the plunger and the movable contact fixed thereto with respect to the actuator may occur during the assembly of the device. Such minor rotation causes no critical problem in the above prior art device since it utilizes the movable contact in the form of a disk capable of contacting at any peripheral portion with the fixed contacts. However, when the movable contact of a bar-shaped or elongated configuration bridging the fixed contacts is utilized, even the minor rotation of the movable contact with respect to the actuator may lead to misalignment of the movable contact with the fixed contact; thereby, failing to keep a predetermined contacting relation between the movable and fixed contacts.

SUMMARY OF THE INVENTION

The above problem has been eliminated in the present invention which provides an improved sealed switch. The sealed switch in accordance with the present invention comprises a vessel defining therein a hermetically sealed space having a length, a width and a depth. The vessel comprises a bottom-open case of an electrically insulative material, a metal-made barrel, and a closure plate. One axial end of the barrel is sealed to the case around a bottom opening thereof and the other axial end of the barrel is sealed to the closure plate. Disposed within the sealed space are a pair of fixed contacts which are arranged in a spaced relation along the length of the sealed space and are electrically connected respectively to a pair of terminals provided on the exterior of the vessel. A movable contact is received within the sealed space to extend along the length thereof in a fashion to bridge the fixed contact. The movable contact is movable between an ON-position where the movable contact comes into contact simultaneously with the fixed contacts at opposite ends of the movable contact and an OFF-position where the movable contact is kept away from the fixed contact. A gas (such as hydrogen or the like) is filled in the sealed space in order to suppress arc development between the movable and fixed contacts. Fixed to the closure plate is a sleeve with a bore through which a plunger extends so as to be slidable along its axis relative to the sleeve. The plunger carries at its axial one end the movable contact and carrying at the other axial end an actuator. The actuator is held together with a portion of the sleeve within a top-open and bottom-closed cylinder in such a manner that the sleeve is disposed adjacent to a top opening of the cylinder and the actuator is disposed adjacent to a bottom of the cylinder. Acting on the actuator is a drive force which drives the plunger axially for movement of the movable contact from the OFF-position to the ON-position. A return spring is provided between the sleeve and the actuator to bias the plunger in a direction of moving the movable contact towards the OFF-position. An over-travel spring is provided to give a bias for moving the movable contact relative to the plunger in order to develop a contacting pressure between the movable contact and the fixed contacts when the plunger is moved further after the movable contact comes first into contact with the fixed contacts. The over-travel spring is supported to a spring holder carried on the plunger. The features of the present invention reside in the plunger being formed with a threaded portion which extends through the actuator to allow the plunger to move axially relative to the actuator for adjustment of a contact gap between the movable contact in the OFF-position and the fixed contact, and in the spring holder being formed with stopper protrusions which project in the width direction of the sealed space in abuttable and slidable relation to the interior surface of the vessel in such a manner that the movable contact is prevented from rotating together with the plunger. With such structural arrangement, the spring holder of the over-travel spring is best utilized to restrict the movable contact from rotating together with the actuator to enable the contact gap adjustment. That is, the elongated movable contact is kept in a correct orientation for exact contact with the fixed contacts during and after the adjustment of the contact gap by rotating the plunger relative to the actuator.

It is therefore a primary object of the present invention to provide a sealed contact device which is capable of adjusting the contact gap between the movable contact and the fixed contacts, yet keeping the elongated movable contact in a correct orientation for an exact contacting relation to the fixed contact.

The stopper projection is formed to have a rounded tip which is slidable on the interior of the vessel so as not to substantially interfere with the movement of the movable contact between the ON-position and the OFF-position.

In a preferred embodiment, the actuator is formed, at one axial end thereof with a slit adapted to receive therein a bit of a screwdriver when rotating the actuator relative to the plunger to axially move the plunger for adjustment of the contact gap.

Further, the bottom of the cylinder may be hermetically sealed with an end plate formed separately from the cylinder. With the use of the separately formed end plate, the actuator is accessible before sealing the cylinder and the vessel but after assembling the cylinder to the vessel to facilitate the gap adjustment in the nearly final assembling condition.

The sleeve is fixed to the top-opening of the cylinder such that the sealed space of the vessel communicates into the interior of the cylinder through the bore of the sleeve. The actuator is disposed between the sleeve and the closed bottom of the cylinder and is formed in its outer surface with a groove which extends the full axial length thereof so as to permit the gas filled in the sealed spaced to flow through the groove beyond the axial length of the actuator within the cylinder. Thus, the actuator can move smoothly without being dampened by the filled gas, thereby minimizing the power requirement for driving the actuator.

The barrel of the vessel may be shaped so as to have a stepped wall section for reinforcing the barrel against a heat stress which may be applied when soldering the barrel to the case and the closure plate. Thus, the vessel is provided with a dimensional stability to keep a predetermined dimensional relation between the operating parts for stable operation.

The device utilizes and electromagnet to drive the actuator for moving the movable contact from the OFF-position to the ON-position. The electromagnet comprises an excitation coil surrounding the cylinder, the closure plate connected to the top end of the sleeve, and a yoke extending from the closure plate towards the bottom end of the cylinder. The yoke cooperates with the actuator, the sleeve, and the closure plate in order to form a magnetic circuit which attracts the actuator towards the sleeve to move the movable contact into the ON-position in response to the excitation coil being energized. The plunger is preferably made of an electrically insulative material so that a possible arc developed between the movable contact and the fixed contacts cannot proceed to the plunger. Thus, the plunger can be kept intact from the possible arc and therefore from being damaged thereby to ensure stable movement over a long period of use.

In a further preferred version, the cylinder comprises a lower tube of a magnetic material and an upper tube of non-magnetic material. The lower tube is connected between the yoke and the actuator to form the magnetic circuit. Thus, the lower tube acts to reduce a magnetic resistance between the actuator and the yoke to thereby enhance efficiency of the magnetic circuit. In order to keep the sleeve magnetically spaced from the actuator for developing a magnetic force of attracting the actuator to the sleeve, the interface between the lower tube and the upper tube is located below the upper end of the actuator when the movable contact is in the OFF-position.

The closure plate may be in the form of a composite plate comprising a pair of exterior layers of magnetic material and an inner layer held between the exterior layers, the inner layer being made of a material having less permeability to the gas than the magnetic material. The exterior layer is selected to be of the material which is readily welded to the other parts of the vessel by the use of a simple laser welder, in addition to being the magnetic material forming the magnetic circuit. The inner layer is made of copper which exhibits a considerably reduced permeability to hydrogen. Thus, the use of the composite plate facilitates the welding of the closure plate to the other parts of the vessel, and prevents the leakage of the hydrogen from within the vessel over a long period of use. In addition, the barrel is not necessarily required to be of the magnetic material; and is therefore selected to be of a material of reduced permeability to hydrogen.

In a preferred embodiment, an arc protector of an electrically insulative material is disposed within the sealed space to hide an interface between the barrel and the case of the vessel from the movable contact for preventing an arc from reaching the interface. Thus, the interface at which the barrel is soldered to the case can be protected from being exposed to the arc, and therefore kept intact for prevention of any leakage of hydrogen which would be possible through otherwise damaged soldered portion. A spring is provided to urge the arc protector against the interior of the vessel for successfully hiding the above interface from the arc.

These and still other objects and advantageous features of the present invention will become more apparent from the following detailed description of the embodiments when taken in conjunction with the attached drawings.

DETAILED DESCRIPTION OF THE EMBODIMENTS

First Embodiment <FIGS. 1 to 9>

Figure 1:
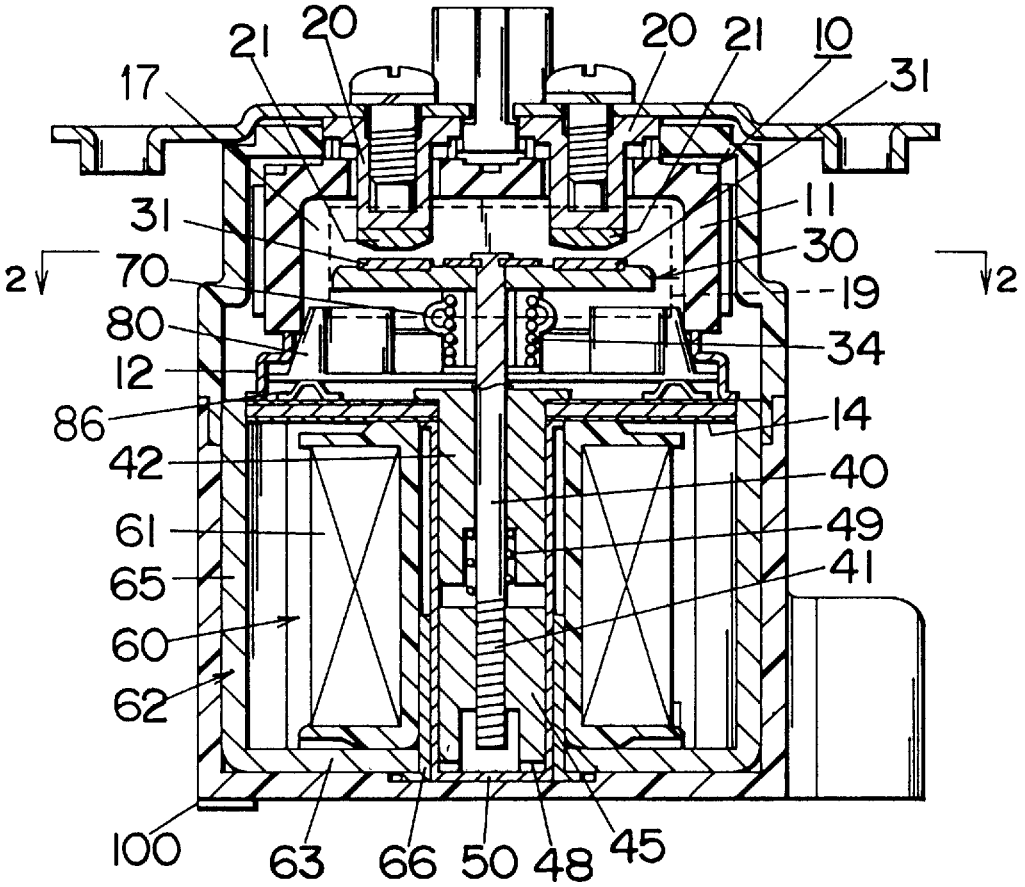
FIG. 1 is a vertical section of a sealed contact device in accordance with a first embodiment of the present invention.
Figure 2:
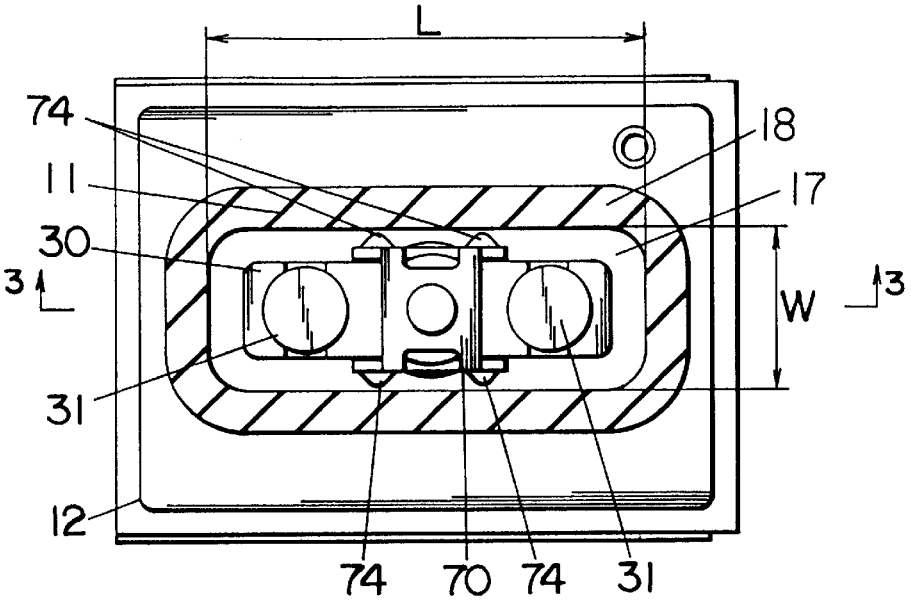
FIG. 2 is a cross-section taken along line 2—2 of FIG. 1.
Figure 3:
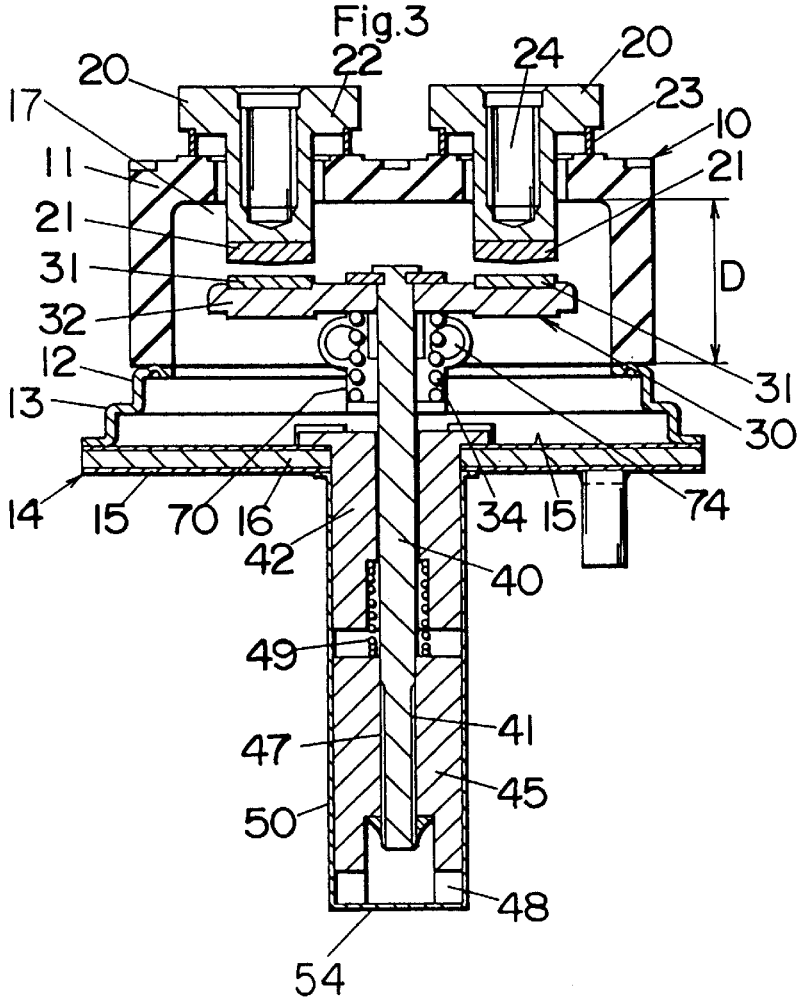
FIG. 3 is a cross-section taken along line 3—3 of FIG. 2.

Referring now to FIGS. 1 to 9, there is shown a sealed contact device in accordance with a first embodiment of the present invention. The contact device is utilized, for example, as a DC power relay or the like for controlling a high electric current. As best shown in FIGS. 1 and 3, the contact device comprises a sealed vessel 10 defining therein a hermetically sealed space 17 for accommodating therein a pair of fixed contacts 21 and an elongated movable contact 30 engageable with the fixed contacts 21. The vessel 10 comprises a top-closed and bottom-open electrically insulative ceramic case 11 of alumina, a metal-made barrel 12, and a metal-made closure plate 14. The barrel 12 is welded or solder at its upper end to the entire circumference of the case 11 around the bottom opening thereof, and welded at its lower end to the entire circumference of the closure plate 14. The welding or soldering is made to the entire circumference of the barrel 12 to hermetically seal the barrel 12 to the case 11 as well as to the plate 14. The closure plate 14 constitutes a portion of a magnetic circuit for driving the movable contact 30 and is therefore selected to exhibit ferromagnetism. The plate 14 is made of a composite material having a pair of exterior layers 15 of soft-iron exhibiting the required ferromagnetism and an interior layer 16 of copper which is selected for the reason as discussed hereinafter. The barrel 12 is made of Fe-42% Ni alloy which is selected to have thermal expansion coefficient intermediate between those of the alumina forming the case 11 and the soft-iron forming the exterior of the closure plate 14 for successfully achieving the welding or soldering of the barrel 12 to the case 11 and to the plate 14. The barrel 12 is shaped to have a stepped wall section 13 by which the barrel 12 is reinforced to give a sufficient mechanical strength for giving dimensional stability particularly at interfaces with the case 11 and closure plate 14. The vessel 10 is enclosed by a housing 100 composed of upper and lower halves.

Hydrogen gas is filled within thus sealed space of the vessel 10 in order to suppress arc development between the contacts and to minimize a contact gap between the movable contact 31 and the fixed contacts 21. Hydrogen gas referred throughout the description is meant to express a gas of which chief component is a hydrogen. The minimized contact gap is advantageous for reducing the size of the device as well as for reducing a power requirement for driving the movable contact. In this instance, the contact gap is selected to be approximately 1 mm. Due to the minimizing of the leakage of hydrogen through the metal-made barrel 12 and the closure plate 14, the Fe-42% Ni alloy and copper are selected as forming the barrel 12 and the interior layer 16 of the plate 14, respectively, since they exhibit only reduced permeability to hydrogen. When assuming that the soft-iron has a hydrogen permeability of 1 at 150° C., Fe-42% Ni alloy and copper have relative permeability of 0.014 and $5.8\times10^{-5}$, respectively. The three-layers composite plate 14 is prepared by cladding of the soft-iron exterior layers 15 on the copper interior layer 16.

As shown in FIGS. 2 and 3, the ceramic case 11 is shaped to give a rectangular sealed space having a length L, width W and depth D. It is along the length L which is made greater than the width W that the pair of fixed contacts 21 are spaced and that the movable contact 30 extends. The fixed contacts 21 and the movable contact 30 are disposed within the depth D of the case 11. The fixed contacts 21 are provided respectively on the lower ends of metal-made terminals 20 which penetrate through the top wall of the case 11. A seal ring 23 is held between a head 22 of the terminal 20 and the top surface of the case 11 to hermetically seal between the terminal and the case. The head 22 is formed with a screw hole 24 for wiring connection to a circuit to be energized by the contact device. The movable contact 30 comprises a pair of chips 31 provided on opposite lengthwise ends of an elongated bar 32 in registration with the fixed contacts 21. The bar 32 is supported to an upper end of a plunger 40 and is driven thereby to move between an ON-position where the movable contact 30 or chips 31 are in contact with the fixed contacts 21 and an OFF-position where the movable contact 30 is kept away from the fixed contacts 21. The plunger 40 is slidably supported by a sleeve 42 to be movable along an axis thereof. The sleeve 42 is secured at its upper end to the closure plate 14 to depend therefrom and has an axial bore 43 through which the plunger 40 extends. Carried at the lower end of the plunger 40 is an actuator or armature 45 which is attracted to the sleeve 42 by operation of an electromagnet 60 for movement of the movable contact 30 into the ON-position from the OFF-position. To this end, the sleeve 42 and the actuator 45 are respectively made of a magnetic material, and may be referred to respectively as fixed core and a movable core. The sleeve 42 and the actuator 45 are received in a cylinder 50 of a non-magnetic material which has a closed bottom 54 and is welded or soldered at its upper open end to the closure plate 14 in a sealed fashion so that the sealed space in the vessel 10 extends into the interior of the cylinder 50 through the bore 43 of the sleeve 42. A return spring 49 is held between the sleeve 42 and the actuator 45 to urge the plunger 40 in the direction of moving the movable contact to the OFF-position from the ON-position. The actuator 45 is formed with a threaded hole 47 with which a thread 41 at the lower end 41 of the plunger 40 engages. By this threaded engagement, the rotation of the actuator 45 causes the plunger 40 to move axially relative to the actuator 45 to thereby adjust the contact gap. For this purpose, the actuator 45 is formed in its lower end with a slit 48 receiving a tip of a screwdriver or the like. The plunger 40 is restricted from rotating together with the actuator 45 by a structure as described hereinafter. After making the adjustment of the contact gap, the actuator 45 is fixed to the plunger 40 by the use of an adhesive followed by the cylinder 50 being secured to the closure plate 14 to entirely seal the interior of the vessel 10, after which the hydrogen gas is filled in the sealed space. The actuator 45 is formed in its outer surface with a groove 46 extending the full axial length thereof in order to allow the hydrogen gas to flow through the groove 46 beyond the actuator 45 moving in the cylinder 50. Thus, the actuator 45 can move smoothly within the gas-filled cylinder 50 without being dampened by the hydrogen gas.

Figure 4:
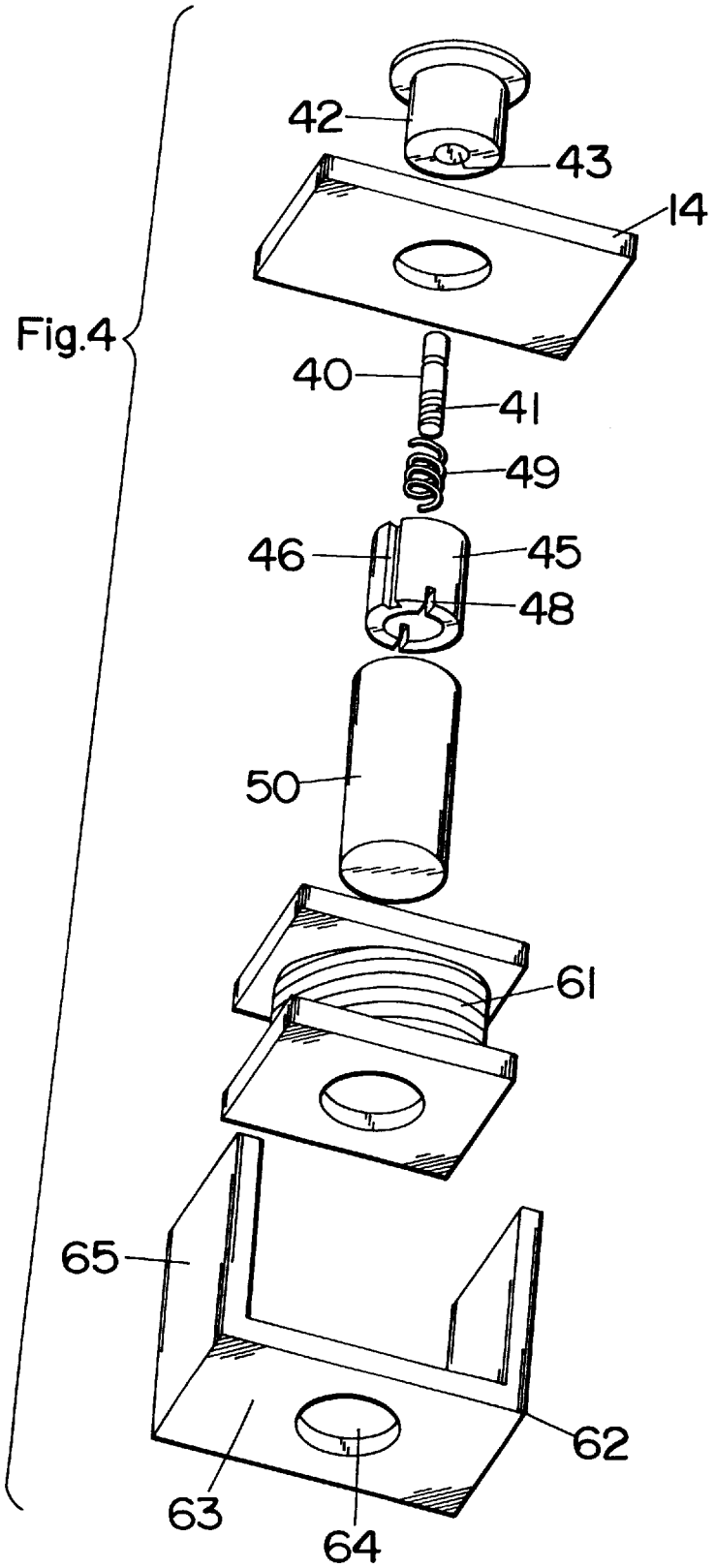
FIG. 4 is an exploded perspective view of a mechanism for driving the contact device.

As shown in FIGS. 1 and 4, the electromagnet 60 comprises an excitation coil 61 disposed around the cylinder 50, and a yoke 62 of a magnetic material The yoke is of a generally U-shaped configuration having a base 63 with an opening 64 and a pair of legs 65 upstanding from opposite ends of the base 63. It is within the hole 64 of the yoke 62 within which the lower end of the cylinder 50 is received together with a bushing 66 of a magnetic material. The upper end of each leg 65 of the yoke 62 mates with the outer periphery of the closure plate 14 so as to be cooperative with the bushing 66, the actuator 45, the sleeve 42, and closure plate 14 to form a magnetic circuit. Upon energization of the coil 61, the resulting magnetic flux acts to attract the actuator 45 to the sleeve 42 against the bias of the return spring 49 to thereby move the movable contact 30 to the ON-position. The actuator 45 and the plunger 40 are permitted to continue moving upwardly after the movable contact 30; i.e., chips 31 thereof come first into contact with the fixed contacts 21 so as to give a desired contact pressure therebetween by an action of an over-travel spring 34.

Figure 5:
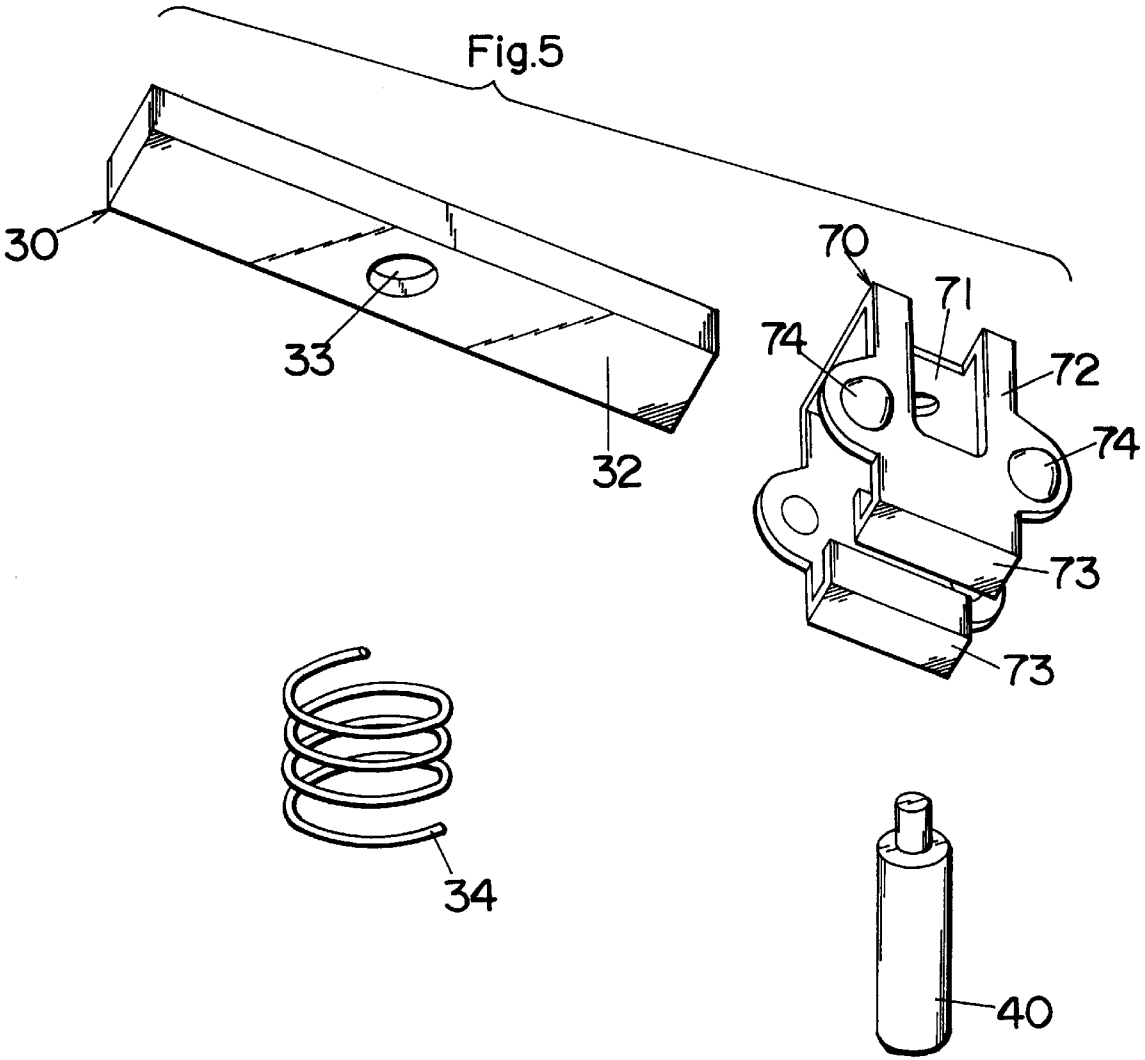
FIG. 5 is an exploded perspective view of a structure for giving a contact pressure between a movable contact and fixed contacts of the device.
Figure 6:
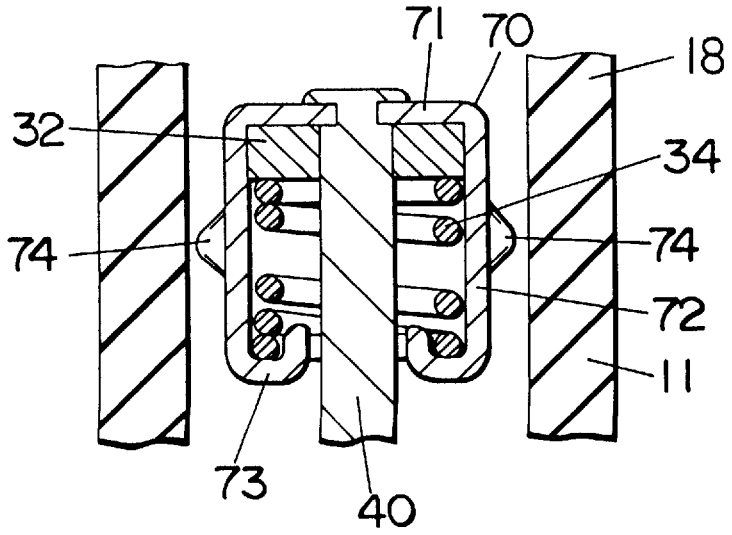
FIG. 6 is a sectional view of the above structure.
Figure 7:
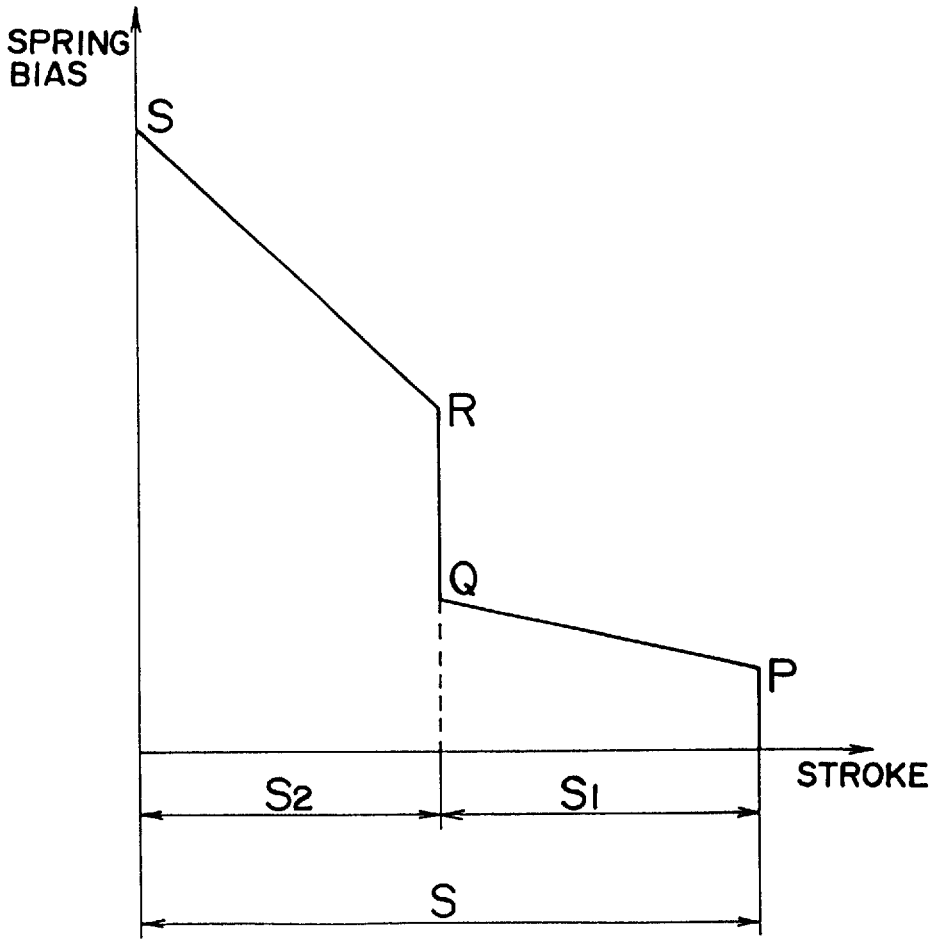
FIG. 7 is a graph illustrating a relation between a stroke of a plunger and a spring bias applied to the movable contact of the above device.

The over-travel spring 34 is held between the bar 32 of the movable contact 30 and a spring holder 70 secured to the upper end of the plunger 40. As best shown in FIGS. 5 and 6, the spring holder 70 is a generally U-shaped member having a top wall 71 and a pair of side walls 72 depending from opposite ends of the top wall. Projecting inwardly from the lower ends of the side walls 72 are catch lips 73 for retention of the over-travel spring 34. The plunger 40 extends through between the catch lips 73 and through a center hole 33 of the movable contact 30 with a distal upper end of the plunger 40, while the upper distal end of the plunger 40 is fixedly engaged into a hole in the top wall 71 of the carrier 70. The movable contact 30 is loosely engaged with the plunger 40 so that it is movable along an axis of the plunger 40 relative to the spring holder 70 and the plunger 40. The over-travel spring 34 is held between the catch lips 73 and the movable contact 30 for biasing the movable contact 30 upwardly. When the plunger 40 continues to move upwardly as a result of the actuator 45 being attracted to the sleeve 42 after the movable contact 30 engages with the fixed contacts 21, the spring holder 70 is allowed to move together with the plunger 40 to thereby compress the over-travel spring 34 between the catch lips 73 and the bar 32 of the movable contact 30, thereby providing a corresponding contact pressure between the movable contact 30 and the fixed contacts 21. FIG. 7 shows a relation between the plunger movement and a sum of the spring bias accumulated in the return spring 49 and the over-travel spring 34. Upon energization of the excitation coil 61, the actuator 45 is attracted to the sleeve 42 to move the plunger 40 and the movable contact 30 by a distance S1 defining the contact gap, during which the return spring 49 is compressed to increase the spring bias from P to Q. The spring bias is then rapidly increased to R as a consequence of the movable contact 30 is stopped against the fixed contacts 21. Even after the movable contact 30 is stopped, the plunger 40 is allowed to move continuously upward by an over-travel distance S2 to compress the over-travel spring 34 to further increase the spring bias from R to S by the action of compressing the over-travel spring 34. Therefore, as soon as the excitation coil 61 is deenergized, thus accumulated spring bias acts to rapidly move the movable contact 30 downwardly for impact break of the contacts.

The spring holder 70 is formed on its side walls 72 respectively with stopper protrusions 74 which, as best in FIGS. 2, 5, and 6, project in the width direction of the vessel 10 in an abuttable and slidable relation to the opposite interior walls 18 of the case 11. The stopper protrusions 74 define a restrictor which prevents the plunger 40 and the movable contact 30 from rotating together with the actuator 45, therefore enabling an easy adjustment of the contact gap simply by rotating the actuator 45 around the plunger 40. The stopper protrusions 74 are made by stamping the side walls of the metal-made spring holder 70 from inside thereof to have rounded tips which reduce friction against the interior of the case 11 if the movable contact 30 moves with the stopper protrusions 74 abutted against the interior walls 18 of the vessel 10.

It is possible that an undesired arc develops between the movable contact 30 and the fixed contacts 21 upon separation of the contacts and that one end of the arc may transfer from the fixed contacts to the adjacent metal-made barrel 12 and even to the metal-made closure plate 14. If this occurs, the arc could reach the barrel 12, particularly the soldered portion of the barrel 12 with the ceramic case 11, leaving thereat an interface defect through which the hydrogen gas would leak. In order to prevent such undesired effect of the arc, an arc protector 80 is provided in the vessel 10 to hide the barrel 12, particularly the interfaces with the case 11 and the plate 14, from the arc extending from the fixed contacts. The arc protector 80 is made of an electrically insulative material such as ceramics and nylon-alumina composite resins. Preferably, the protector 80 is made from a urea resin or unsaturated polyester resins which generates hydrogen upon exposed to the arc and does not cause much isolated carbons. In addition to the arc protector 80, a pair of permanent magnets 19 (only indicated by dotted line in FIG. 1) are disposed on the exterior of the vessel 10 to develop a magnet field extending along the width direction of the vessel for stretching the arc initially made between the movable contact 30 and the fixed contacts 21 in the direction in which the are moves outwardly along the length of the vessel 10 for extinction of the arc and for preventing the transfer of the arc from reaching the barrel 12.

Figure 8:
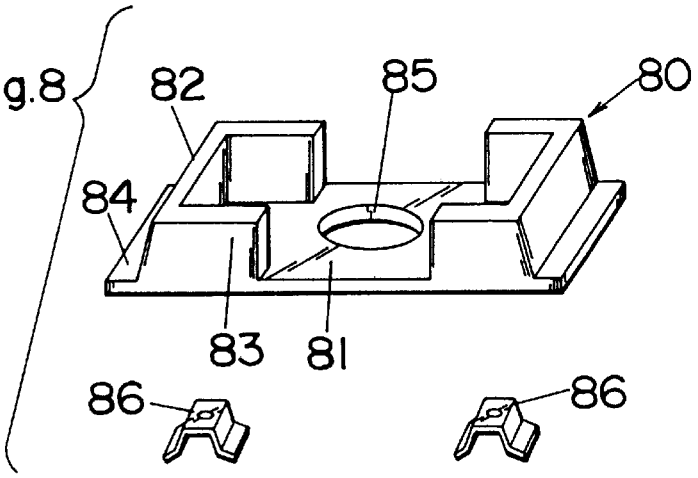
FIG. 8 is an exploded perspective view of an arc protector utilized in the above device.
Figure 9:
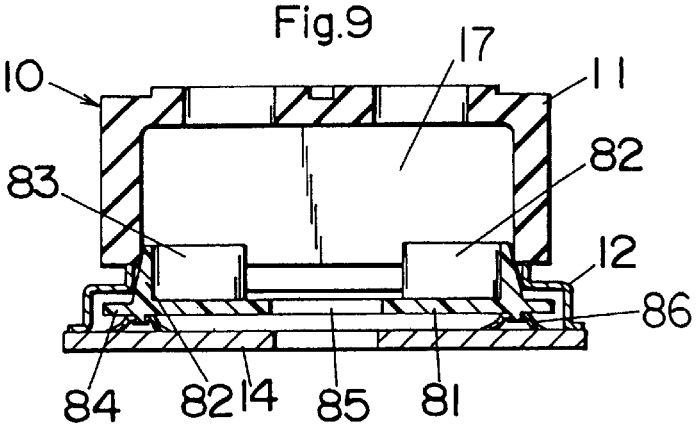
FIG. 9 is a sectional view of the above arc protector in its assembled condition.

As shown in FIG. 8, the arc protector 80 according to the present embodiment comprises a rectangular base 81 integrally formed with a pair of shield extensions 82 upstanding from the opposite longitudinal ends of the base 81 to cover the entire interface of the barrel 12 with the case 11 at the longitudinal ends of the vessel as well as to adjacent portions of the interface spaced inwardly from the longitudinal ends of the vessel. The base 81 covers the entire portion of the closure plate 14 and the interface thereof with the barrel 12 and is formed with a center opening 85 through which the plunger 40 extends loosely. The shield extension 82 is made thicker towards the base 81 to define an inclined exterior surface. A pair of spring shoes 86 are attached to the bottom of the base 81 to bias the arc protector 80 upwardly for constant abutment of the inclined exterior surface of the shield extension 82 to the bottom edge of the case 11, as best shown in FIG. 9, for successfully concealing the barrel 12 and the interface thereof with the case 11 from the fixed contacts 21. The spring shoes 86 may be molded integrally with the arc protector 80. Inwardly projecting portions 83 of the shield extension 82 can protect the interface of the barrel 12 with the case 11 from the arc even when the arc is driven to move to some extent in the width direction of the vessel. Longitudinal ends 84 of the base 81 projects deep into the stepped wall section 13 to cover the interface of the barrel 12 with the closure plate 14 for protection of the interface or the adjacent portion of the plate from the arc.

Figure 10:
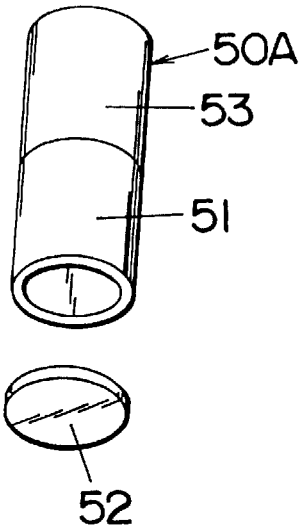
FIG. 10 is an exploded perspective view of a cylinder utilized in a modification of the above embodiment.
Figure 11:
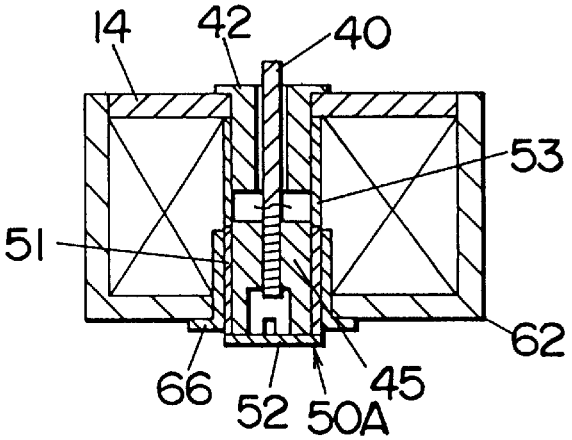
FIG. 11 is a sectional view of the above cylinder shown in its assembled condition.

In the above embodiment, the entire cylinder 50 fitted over the actuator 45 and the sleeve 42 is made from the non-magnetic material. However, a composite cylinder made from different materials may be utilized instead. FIG. 10 shows such modified cylinder 50 which comprises a lower tube 51 of magnetic material, a bottom cap 52 of the same magnetic material, and an upper tube 53 of a non-magnetic material. The lower tube 51 of magnetic material is made in direct contact between the bushing 66 and the actuator 45 both of the magnetic material to enhance the flux density of the magnetic circuit circulating through the yoke 62, bushing 66, actuator 45, sleeve 42, and the closure plate 14. The upper tube 53 of non-magnetic material is required to avoid short-circuiting of the magnetic flux across the actuator 45 and the sleeve 42 and therefore the interface between the upper tube 53 and the lower tube 51 should be below the upper end of the actuator 45 at its OFF-position, as shown in FIG. 11. The upper and lower tubes are integrated as a unitary tube structure, which is welded at its upper end with the closure plate 14. The bottom cap 52 can be secured to close the bottom of the cylinder after the tube structure is welded to the plate 14 so as to allow an easy adjustment of the contact gap with the actuator 45 held in the cylinder 50A, i.e., the contact gap adjustment after assembling the sleeve 42 and the actuator 45 into the cylinder 50A. Although the separately formed end cap is shown in conjunction with the cylinder 50A composed of upper and lower tubes, it may be equally adapted in the single cylinder 50 of the non-magnetic material as utilized in the first embodiment.

Figure 12:
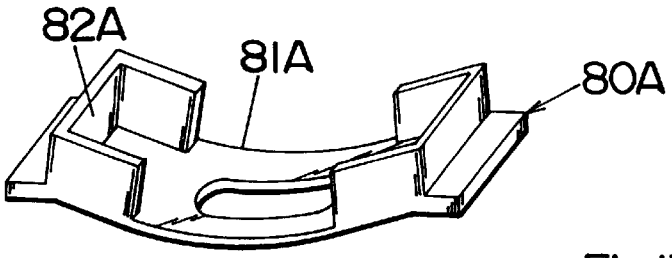
FIG. 12 is a perspective view of another arc protector utilized in a second embodiment of the present invention.
Figure 13:
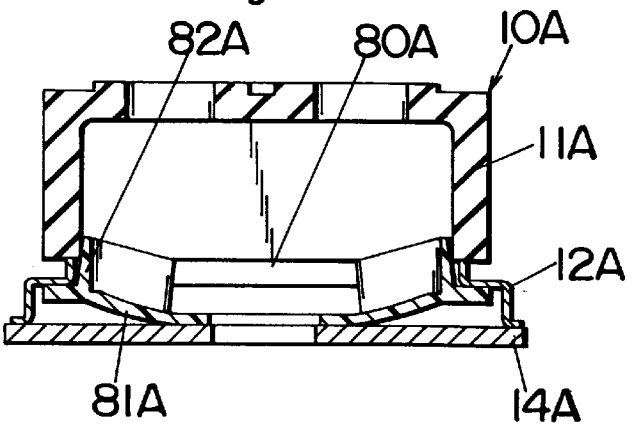
FIG. 13 is a sectional view of the above arc protector in its assembled condition.

FIGS. 12 and 13 illustrate a second embodiment of the present invention in which an arc protector 80A of different configuration is utilized. The arc protector 80A is basically identical to that of the first embodiment except that a base 81A is made resiliently flexible. Like parts are designated by like numerals with a suffix letter of "A". The base 81A is made to be somewhat deformed when assembled into the vessel 10A to develop a resulting bias for urging the shield extensions 82A against the bottom of the case 11A to retain the arc protector in a desired position for protecting the barrel 12A from the arc.

Figure 14:
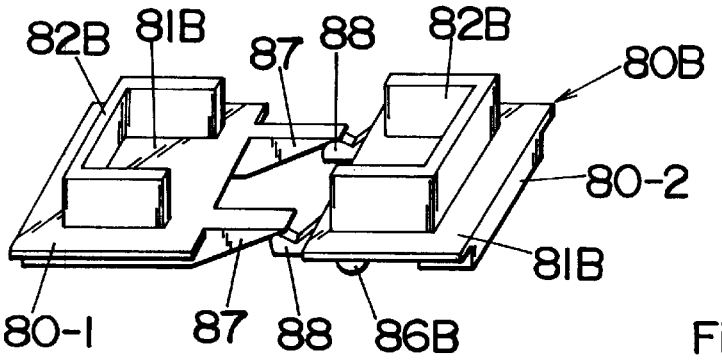
FIG. 14 is a perspective view of another arc protector utilized in a third embodiment of the present invention.
Figure 15:
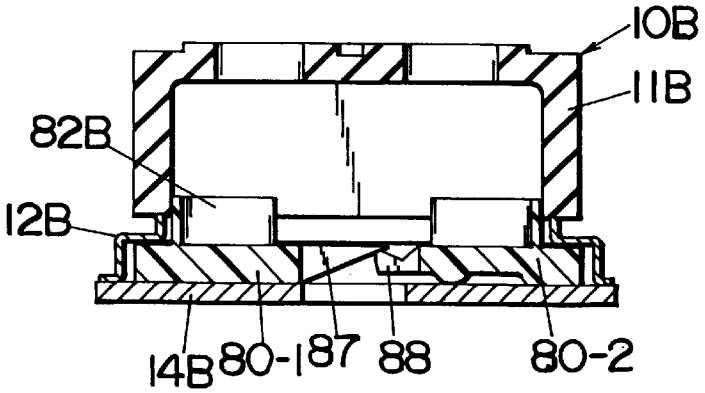
FIG. 15 is a sectional view of the above arc protector in its assembled condition.

FIGS. 14 and 15 illustrate a third embodiment of the present invention utilizing an arc protector 80B composed of a pair of two separate protector halves 80-1 and 80-2. Like parts are designated by like numerals with a suffix letter of "B". Each half comprises a base 81B with a like shield extension 82B so that the combination thereof gives the like configuration as that of the first embodiment. One protector half 80-1 is formed with a pair of cantilevers 87 with inclined lower surfaces. The other protector half 80-2 is formed with a pair of projections 88 which comes into contact respectively with the inclined lower surfaces of the cantilevers 87 when assembled in the vessel 10B. The protector half 80-2 is also formed with an elastic shoe 86B which gives an upward bias to the protector half 80-2. The upward bias is translated into sideward biases at the contact engagement between the projections 88 and the cantilevers 87 for urging the two protector halves in a direction of moving away from each other, thereby pressing the shield extensions 82B against the bottom edge of the case 11B to cover the barrel 12B, particularly the interface thereof with the case 11B, as shown in FIG. 15.

Figure 16:
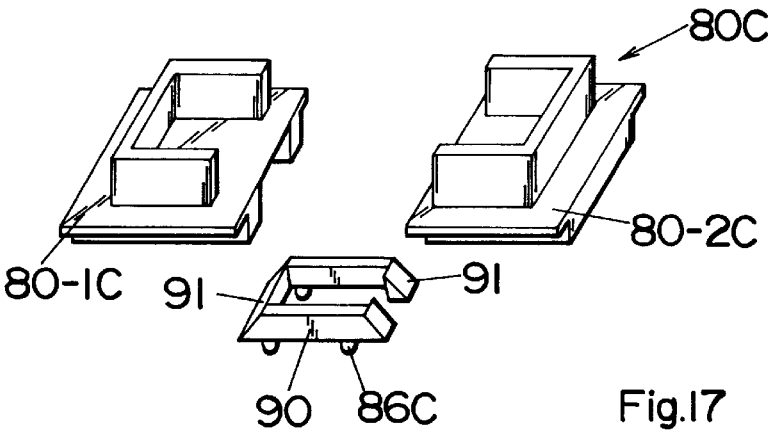
FIG. 16 is a perspective view of another arc protector utilized in a fourth embodiment of the present invention.
Figure 17:
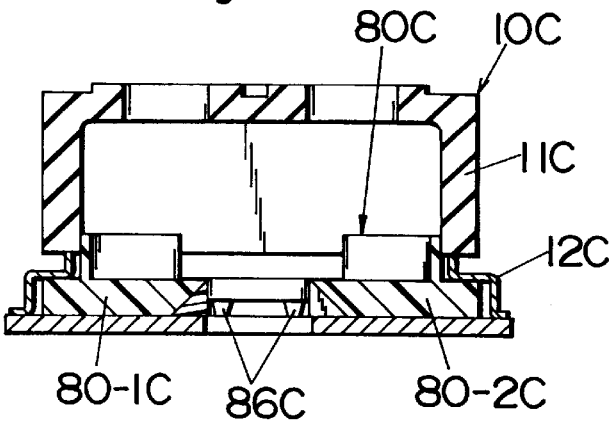
FIG. 17 is a sectional view of the above arc protector in its assembled condition.

FIGS. 16 and 17 illustrate a fourth embodiment of the present invention which utilizes an arc protector 80C composed of a pair of two protector halves 80-1C and 80-2C and a center member 90. The like parts are designated by like numerals with a suffix letter of "C". The center member 90 is formed at its opposed ends with wedge surfaces 91 which engages with correspondingly inclined surfaces formed at the inward ends of the protector halves 80-1C and 80-2C. Like elastic shoes 86C are formed on the bottom of the center member 90 to bias it upwardly when the arc protector 80C is assembled into the vessel 10C. The resulting bias is then translated into sidewards biases at the wedge surfaces 91 for urging the two protector halves in a direction of moving away from each other, thereby pressing the shield extensions 82C against the bottom edge of the case 11C to cover the barrel 12C, particularly the interface thereof with the case 11C, as shown in FIG. 17.

Figure 18:
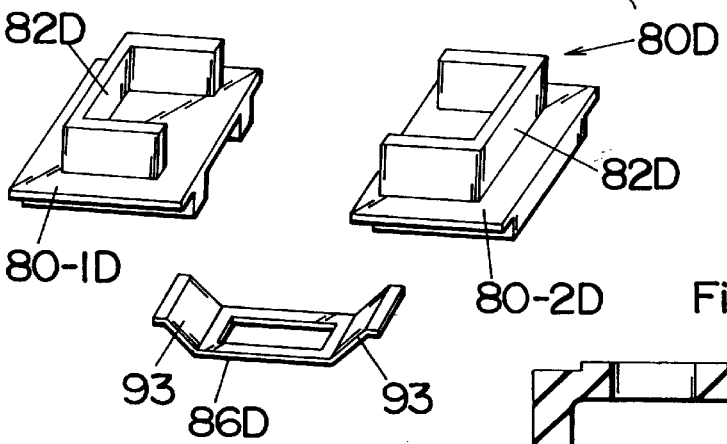
FIG. 18 is a perspective view of another arc protector utilized in a fifth embodiment of the present invention.
Figure 19:
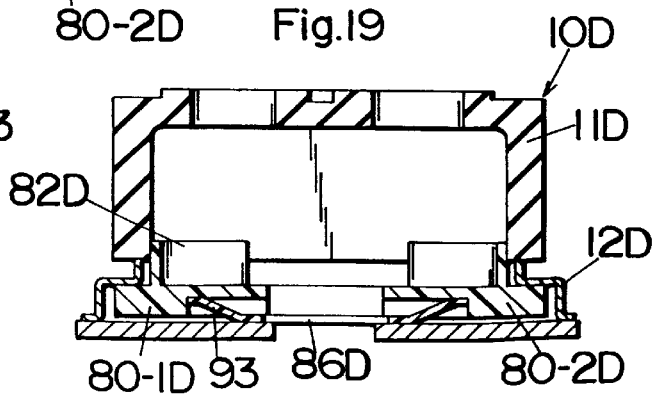
FIG. 19 is a sectional view of the above arc protector in its assembled condition.

FIGS. 18 and 19 illustrate a fifth embodiment of the present invention, which utilizes an arc protector 80D composed of a pair of two protector halves 80-1D and 80-2D and a separate spring shoe 86D bridging between the two halves. The like parts are designated by like numerals with a suffix letter of "D". The spring shoe 86D is formed to have a pair of resilient elements 93 extending from opposite ends of a center element 92 and engaging with the two protector halves, respectively. When the arc protector 80D is assembled into the vessel 10D, the resilient elements 93 are deformed to give resulting biases for urging the two protector halves 80-1D and 80-2D sidewards in a direction of moving away from each other, thereby pressing the shield extensions 82D against the bottom edge of the case 11D to cover the barrel 12D, particularly the interface thereof with the case 11D, as shown in FIG. 19.

Figure 20:
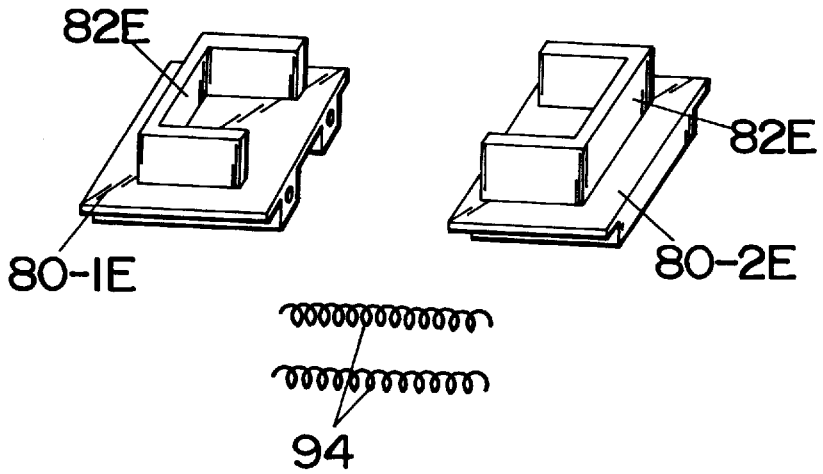
FIG. 20 is a perspective view of another arc protector utilized in a sixth embodiment of the present invention.
Figure 21:
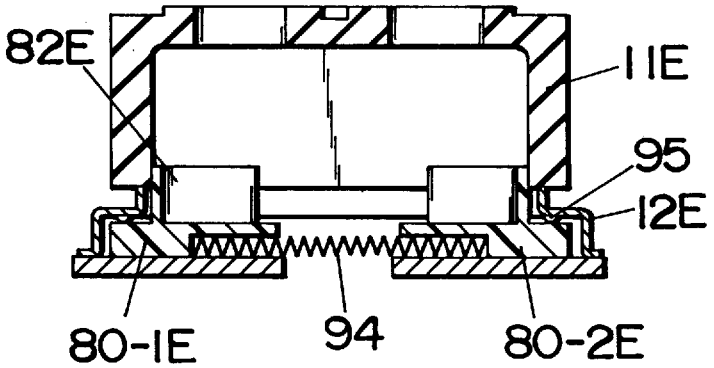
FIG. 21 is a sectional view of the above arc protector in its assembled condition.

FIGS. 20 and 21 illustrate a sixth embodiment of the present invention, which utilizes an arc protector 80E composed of a pair of two protector halves 80-1E and 80-2E interconnected by coil springs 94. The like parts are designated by like numerals with a suffix letter of "E". The coil springs 94 exert biases for urging the two protector halves 80-1E and 80-2E sidewards in a direction of moving away from each other, thereby pressing the shield extensions 82E against the bottom edge of the case 11E to cover the barrel 12E, particularly the interface thereof with the case 11E, as shown in FIG. 21. A cushioning member 95 is provided at the mating surfaces of the arc protector 80E with the barrel 12E in order to eliminate waving of the arc protector 80E.

While the invention has been particularly shown and described in reference to preferred embodiments thereof, it will be understood by those skilled in the art that changes in form and details may be made therein without departing from the spirit and scope of the invention.

What is claimed is:

1. A sealed contact device, comprising:

a vessel defining therein a hermetically sealed space having a length, a width and a depth, said vessel including a bottom-open case of an electrically insulative material, a metal-made barrel, and a closure plate, said barrel having one axial end sealed to said case around a bottom opening thereof and having the other axial end sealed to said closure plate;

a pair of fixed contacts accommodated within said sealed space in a spaced relation along said length of said sealed space, said fixed contacts being electrically connected respectively to a pair of terminals provided on the exterior of said vessel;

a movable contact accommodated within said sealed space and extending along said length thereof to bridge said fixed contacts, said movable contact being movable between an ON-position where said movable contact comes into contact simultaneously with said fixed contacts at opposite ends of said movable contact and an OFF-position where said movable contact is kept away from said fixed contacts;

one of a hydrogen gas and a hydrogen-rich gas filled in said sealed space;

a sleeve fixed to said closure plate and having a bore;

a plunger extending through the bore of said sleeve so as to be slidable along its axis relative to said sleeve, said plunger carrying at its axial one end said movable contact and carrying at the other axial end an actuator, said actuator being held together with a portion of said sleeve within a top-open and bottom-closed cylinder with said sleeve disposed adjacent to a top opening of said cylinder and with said actuator disposed adjacent to a bottom of said cylinder;

drive means which acts on said actuator to drive said plunger axially for movement of said movable contact from said OFF-position to said ON-position;

a return spring which biases said plunger in a direction of moving said movable contact towards said OFF-position; and an over-travel spring which biases said movable contact to move relative to said plunger so as to develop a contacting pressure between said movable contact and said fixed contacts, said over-travel spring being supported to a spring holder carried on said plunger, wherein said plunger is formed with a threaded portion which extends through said actuator in threaded engagement therewith to allow said plunger to move axially relative to said actuator for adjustment of a contact gap between said movable contact in said OFF-position and said fixed contacts, and wherein said spring holder is formed with stopper protrusions which project in the width direction of said sealed space in abuttable and slidable relation to the interior surface of said vessel such that said movable contact is prevented from rotating together with said plunger relative to the actuator.

2. A sealed contact device as set forth in claim 1, wherein said stopper protrusions are formed to have rounded tips.

3. A sealed contact device as set forth in claim 1, wherein said actuator is formed in its one end opposite to said sleeve with a slit adapted to receive a bit of a screwdriver.

4. A sealed contact device as set forth in claim 1, wherein said sleeve being fixed to the top-opening of said cylinder such that said sealed space of said vessel communicates into the interior of said cylinder through the bore of the sleeve, said actuator being disposed between said sleeve and said closed bottom of the cylinder and being formed in its outer surface with a groove which extends the full axial length thereof so as to permit said gas filled in said sealed spaced to flow through said groove beyond the axial length of said actuator within said cylinder.

5. A sealed contact device as set forth in claim 1, wherein the bottom of said cylinder is hermetically sealed with an end plate formed separately from said cylinder.

6. A sealed contact device as set forth in claim 1, wherein said barrel being shaped to have a stepped wall section.

7. A sealed contact device as set forth in claim 1, wherein said drive means is defined by an electromagnet which comprises an excitation coil surrounding said cylinder, said closure plate connected to the top end of said sleeve, and a yoke extending from said closure plate towards the bottom end of said cylinder, said yoke being cooperative with said actuator, said sleeve, and said closure plate to form a magnetic circuit which attracts said actuator towards said sleeve to move said movable contact in said ON-position in response to said excitation coil being energized.

8. A sealed contact device as set forth in claim 7, wherein said plunger is made of an electrically insulative material.

9. A sealed contact device as set forth in claim 7, wherein said cylinder comprises a lower tube of a magnetic material and an upper tube of non-magnetic material, said lower tube being connected between said yoke and said actuator to form said magnetic circuit, the interface between said lower tube and said upper tube being located below the upper end of said actuator when said movable contact is in said OFF-position.

10. A sealed contact device as set forth in claim 7, wherein said closure plate is in the form of a composite plate comprising a pair of exterior layers of magnetic material and an inner layer held between said exterior layers, said inner layer being made of a material having less permeability to said gas than said magnetic material.

11. A sealed contact device as set forth in claim 1, wherein an arc protector of an electrically insulative material is disposed within said sealed space to hide an interface between said barrel and said case of the vessel from said fixed contacts for preventing an arc from reaching said interface.

12. A sealed contact device as set forth in claim 11, wherein spring means is provided to urge said arc protector against the interior of said vessel.

* * * * *